US007285179B2

(12) United States Patent
Snekkenes et al.

(10) Patent No.: US 7,285,179 B2
(45) Date of Patent: Oct. 23, 2007

(54) CONTINUOUS DIGESTER FOR CELLULOSE PULP INCLUDING METHOD AND RECIRCULATION SYSTEM FOR SUCH DIGESTER

(75) Inventors: Vidar Snekkenes, Karlstad (SE); Mikael Lindstrom, Stockholm (SE)

(73) Assignee: Metso Fiber Karlstad AB, Karlstad (SE)

( * ) Notice: Subject to any disclaimer, the term of this patent is extended or adjusted under 35 U.S.C. 154(b) by 732 days.

(21) Appl. No.: 10/471,431

(22) PCT Filed: Mar. 19, 2002

(86) PCT No.: PCT/SE02/00516

§ 371 (c)(1),
(2), (4) Date: Sep. 10, 2003

(87) PCT Pub. No.: WO02/075044

PCT Pub. Date: Sep. 26, 2002

(65) Prior Publication Data

US 2004/0112554 A1 Jun. 17, 2004

(30) Foreign Application Priority Data

Mar. 21, 2001 (SE) ..... 0100982

(51) Int. Cl.
*D21C 3/26* (2006.01)

(52) U.S. Cl. ..... 162/19; 162/37; 162/41; 162/52; 162/59; 162/151; 162/237; 162/239; 162/246

(58) Field of Classification Search ..... 162/19, 162/37, 41, 42, 52, 59, 151, 237, 239, 246, 162/248

See application file for complete search history.

(56) References Cited

U.S. PATENT DOCUMENTS

| | | | | |
|---|---|---|---|---|
| 4,193,839 | A | 3/1980 | Sherman | |
| 5,080,755 | A | 1/1992 | Backlund et al. | |
| 5,256,255 | A * | 10/1993 | Fagerlund | 162/237 |
| 6,063,238 | A * | 5/2000 | Bergqvist et al. | 162/42 |

* cited by examiner

*Primary Examiner*—Mark Halpern
(74) *Attorney, Agent, or Firm*—Rolf Fasth; Fasth Law Offices

(57) ABSTRACT

The continuous digester is for producing chemical pulp to a process for operating this digester and to a feedback system for the cooking liquid. By means of implementing cooking zones 1st, 2nd, 3rd, 4th and 5th down through the digester, that have a successively decreasing liquid-to-wood ratio, it is possible to obtain a more uniform alkali profile during the cooking. The alkali is kept high at the beginning by means of a high liquid-to-wood ratio, typically over 6:1, which exceeds conventional liquid-to-wood ratios, which are normally around 3.5-5.0:1.

21 Claims, 5 Drawing Sheets

CONTINUOUS DIGESTER FOR CELLULOSE PULP INCLUDING METHOD AND RECIRCULATION SYSTEM FOR SUCH DIGESTER

PRIOR APPLICATION

This application is a U.S. national phase application based on International Application No. PCT/SE02/00516, filed 19 Mar. 2002, claiming priority from Swedish Patent Application No. 0100982-8, filed 21 Mar. 2001.

The present invention relates to a continuous digester in accordance with claim 1, to a process for operating a continuous digester for manufacturing chemical pulp in accordance with claim 15, and to a recirculation system for cooking liquid for a digester.

STATE OF THE ART

In earlier continuous digesters of the conventional type, in the main all the alkali was added at the top of the digester when operation was disruption-free and established. Very high alkali concentrations of about 60 or more grams/litre of cooking liquid were obtained at the top of the digester. As is known, alkali is consumed gradually during the cooking, i.e. very rapidly initially and then more slowly, such that it reaches very low levels in the final phase in these earlier continuous digesters. This meant that the alkali concentration varied within a very wide interval during the cooking, something which gave rise to non-uniform cooking results down through the zones of the digester. In these earlier digesters, there was also the possibility of adding alkali to the bottom of the digester, i.e. in the final countercurrent zone (washing zone), with this preferably only being done on start-up or if the lignin was tending not to be completely released from the pulp. It was possible for the latter situation to arise if the lignin was reprecipitated or if the process was disturbed in other ways.

During the 1980s, the MCC technique was developed, with this technique involving the alkali being divided up into charges. Normally, the majority, i.e. about 75-80%, was added to the cocurrent zone, with 45%-60% being added to the impregnation and 20-35% being added to the cooking zone, and the remaining quantity, i.e. approximately 20-25%, was added to the countercurrent zone. It was thereby possible to reduce the alkali concentration to a level of about 40 grams/litre at the beginning of the impregnation. In this way, it was possible to even out the alkali profile in the cooking to a certain degree. Despite this apportionment, relatively large variations in the alkali concentration arose before and after adding the remaining quantity to the digester.

With the aim of levelling out the alkali profile during the cooking still further, very high liquid-to-wood ratios have begun to be used in preimpregnation vessels and in the cooking zone. This technique constitutes one of the fundamentals in the COMPACT COOKING™ concept developed by Kvaerner Pulping. In this way, it is possible to reduce the alkali concentration in the cooking liquid at the same time, however, as a great deal of alkali is available in total in the cooking liquid during the initial and rapid neutralization process. The quantity of alkali which is required for an efficient neutralization process can then be present in the cooking liquid. In these systems, liquid-to-wood ratios as high as 7:1, and up to 8:1, have been used in pre-impregnation vessels and in digesters having an integrated impregnation zone.

Various suggestions for adjusting the alkali during the cooking in the digester have been applied with a view to levelling out the alkali profile. For example, it is possible to use adjusting circulations, where a quantity of cooking liquid is extracted from the digester and returned to the digester after alkali adjustment, or where cooking liquid which has been extracted, and which is to be returned to the digester, is replaced wholly or in part with dilution liquid, with this chiefly resulting in a reduction in dissolved material (lignin, etc.). Different combinations of alkali ratios or dilution liquid ratios as replacement for extracted cooking liquid have been used, depending on the cooking process in question and the raw wood material.

For example SE,A,9903344 (priority from US 178512/98; Oct. 26, 1998) discloses a system for levelling out the alkali profile which uses a number of positions for adding white liquor. The traditional method for levelling out the alkali profile is to use a majority of the positions for adding white liquor. When the digesters are run conventionally at liquid-to-wood ratios of 2.5:1-3.5:1, these adjusting circulations result in relatively large quantities of cooking liquid having to be extracted from the whole of the pulp column at various sites in the digester. Powerful pumps are required for the circulation at the same time as it is necessary to introduce very finely slitted screens at the extraction positions so as to avoid released fibres being entrained and clogging the systems. This constitutes two conflicting stipulations, i.e. screens of low permeability vs a high circulation capacity, a situation which becomes very evident in modern full-scale digesters of high production capacity, which possess pulp columns in the digester which have diameters of up to 10 metres. At the beginning of the 1980s, and up until today, attempts have been made to use countercurrent cooking for levelling out the alkali content, an approach which has frequently substantially impaired the operability of the digester.

When there is a need to increase the production capacity in existing digesters, COMPACT COOKING™ is a good concept which allows the initial presence of the requisite quantity of alkali due to the relatively high liquid-to-wood ratios. In order to be able to increase the capacity when using earlier cooking techniques (of the MCC technique type) as well, an attempt has also been made to introduce the principle of splitting the addition of white liquor; however, in the systems which have been implemented, this has necessitated the recirculation flow having a higher capacity, in turn requiring more screens in the digester. The systems therefore tend to become more complex and expensive and also more susceptible to disturbances (of the screen-clogging type, etc.), at the same time as a complicated and expensive central pipe system (for recirculating fresh/adjusted cooking liquid) has to be installed inside the digester. (The said SE,A,9903344 is a system of this type).

OBJECT AND PURPOSE OF THE INVENTION

The main object of the invention is to be able to obtain a very uniform alkali profile during the cooking in the continuous digester without the need for a large number of alkali adjustment points.

Essentially all the alkali/white liquor can be added at the beginning of the cooking, where a high liquid-to-wood ratio prevails, thereby facilitating a homogeneous alkali level in the whole of the pulp column.

The need to add alkali/white liquor during the latter part of the cooking, with a view to increasing an alkali concentration which is too low, is therefore reduced.

It has been found that, with the introduction of COMPACT COOKING™, a uniform alkali profile during the whole of the cooking is one of the most important parameters for achieving optimal pulp quality.

Another object is to simplify the actual cooking process and reduce the need for circulation systems, which frequently represent a source of disturbances and increase the cost of the digester as a result of complicated screen, circulation and central piping arrangements.

Yet another object is to be able to simplify the construction of the extraction screens such that it is possible to depart from the rules, which are currently applied, for constructing finely slitted screens. The basic concept according to the invention results in no screens being required, since the recirculation only comprises pipes and a pump, and in it not being any significant problem if occasional chip pieces should be recirculated to the top of the digester.

In a preferred embodiment, the recirculation quantity which is required by each respective recirculation decreases successively proceeding downwards in the digester. This is directly compatible with the circumstances inside the digester, where the degree of compaction of the pulp column increases down through the digester due to successive dissolution and a greater pressure from the overlying pulp column. This makes it possible to obtain a cooking process which is less susceptible to disturbance.

The invention can be applied both to vapour phase digesters and hydraulic digesters, with an inverted top separator as well as a downwardly feeding top separator, and also types without a top separator, and can be used when manufacturing cellulose pulp in accordance with both the sulphite method and the craft method. In a similar way, the raw cellulose material can consist of hardwood, softwood, annual plants (of the bagasse type, etc.), etc.

The invention can also be used in both single-vessel digester systems and two-vessel digester systems. In single-vessel systems, the invention can also be used in an intermediate section of the cooking process, in which this intermediate section is preceded by impregnation of at least one other type of cooking zone and/or terminated by a cooking zone of another type or a washing zone.

LIST OF DRAWINGS

DETAILED DESCRIPTION OF PREFERRED EMBODIMENTS

Figure 1:
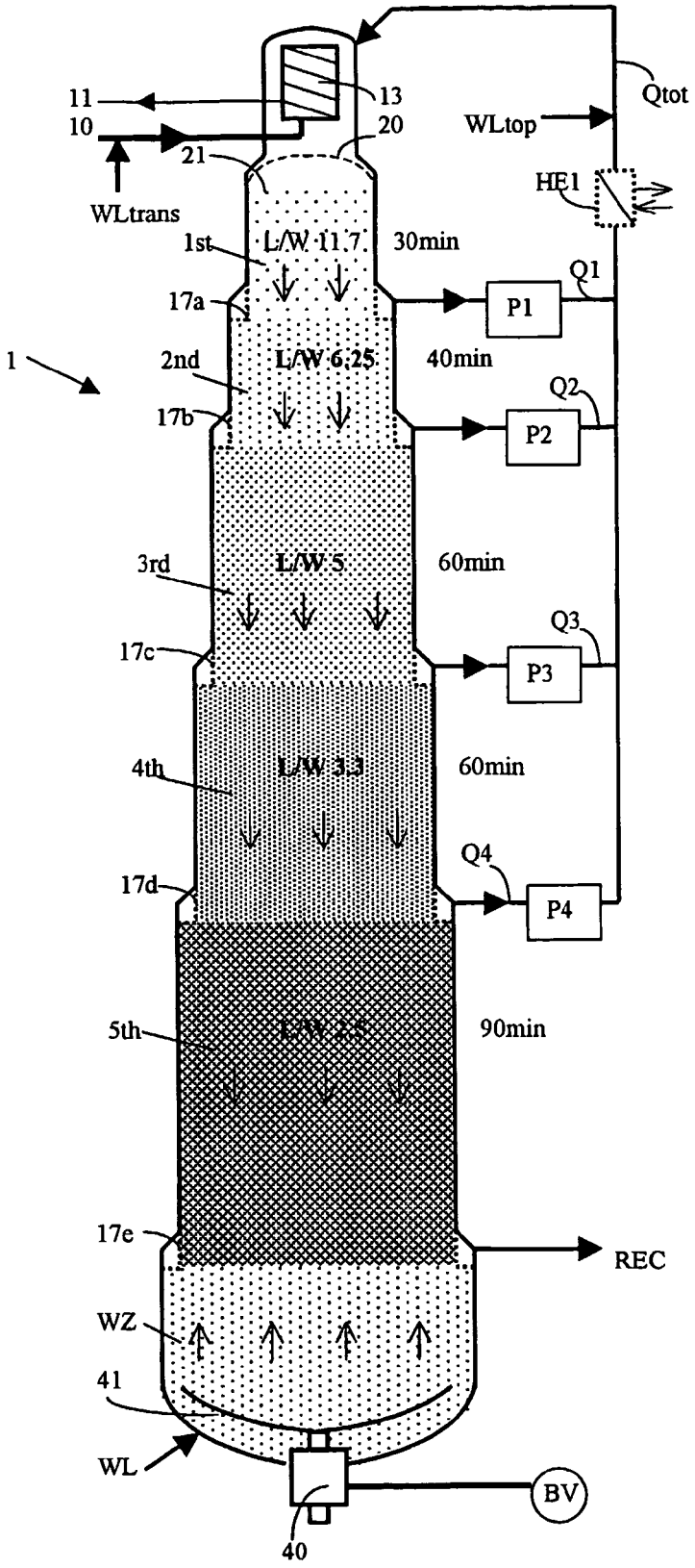
FIG. 1 shows the invention in its simplest embodiment, with 5 different treatment zones.

FIG. 1 shows, in its simplest form, a vapour phase digester 1 for producing chemical pulp, which digester is operated in accordance with the process according to the invention. The pulp mixture (wood chips and cooking liquid consisting of liquor, green liquor, black liquor and/or white liquor, added chemicals, anthraquinone/AQ, polysulphide/PS, condensate and chip moisture content) is fed 10 into an inverted top separator 13 at the top of the digester, where a major part of the free liquid is drawn off and recirculated 11 to the preceding system. The inverted top separator is a feed screw which is fed with the pulp mixture at the bottom and free liquid is drawn off from the pulp mixture as it is transported upwards together with the screw.

The vapour phase digester is characterized by the chips which are fed out from the upper part of the top separator tumbling down in the digester, where a chip level 20 is formed. The chips are heated and impregnated in the vapour phase. A liquor level 21 is established below the chip level 20.

At least 3 cooking zones, in the present case 4-5 cooking zones, labelled 1st-5th, are established in the digester. The first zone, 1st, can be a first impregnation zone, but can also be cooking zone, followed by the cooking zones 2nd/3rd/4th/5th.

The cooking zones or treatment zones are divided off by at least 2, preferably 3, up to a number n, extraction positions, in the present case n=4 extraction positions 17*a*-17*d*. Each cooking zone is established with a substantial dwell time before, between and after each respective extraction position, with the substantial dwell time being within the interval 10-120 minutes, with a shorter dwell time preferably coming into question in the first stage of the cooking and the longer times coming into question during the later part of the cooking. The cooking zones are followed, in a conventional manner, by a washing zone, WZ, where supplied washing liquid TL is used to wash out, or displace, a major part of the used cooking liquor, which used cooking liquor is extracted via the extraction position 17*e*.

The washing liquid TL can be obtained from subsequent process stages and is preferably at a low temperature such that the temperature of the pulp which is fed out from the digester, via the outlet 40 and the blow valve BV, is less than the boiling point, i.e. a cold blow is achieved.

If the subsequent process stage is a pressurized washing apparatus (or pressure diffuser), the washing liquid TL can be used at a higher temperature, thereby enabling the cooking temperature to be maintained for some distance into the washing apparatus.

The cooking temperature is reached successively, and a temperature which is normally about 130-180° C. is reached in the cooking zone.

In accordance with the invention, the liquid-to-wood (L/W) ratio is controlled down through at least three of the digester's constituent cooking zones such that a successively decreasing L/W ratio is obtained.

These constituent cooking zones, with a successively decreasing L/W ratio, can be established down through the whole of the digester, where appropriate with the exception of a concluding countercurrent washing zone, as shown in FIG. 1.

However, these constituent cooking zones with a successively decreasing L/W ratio can also be established in an intermediate section of the digester, where they can be preceded and/or succeeded by impregnation zones or cooking zones of another type.

The greater part of the alkali which is required for the cooking is added to the impregnation zone and/or to the cooking zone by, for example, white liquor, WL, being added to the top of the digester, $WL_{TOP}$, and/or at an earlier point in the transfer, $WL_{TRANS}$.

A successively decreasing liquid-to-wood ratio is obtained by free cooking liquid being extracted from the end of each constituent cooking zone, via the extraction screens

17*a*-17*d*, and recirculated, via the pumps P1-P4, to the beginning of the first constituent cooking zone. The feedback to the top of the digester takes place by way of a simple pipe system using pumps P1-P4. However, it is possible to use a common pump. Since this simple embodiment does not involve any risks of central pipes, inter alia, becoming clogged, open screens can be located in the extraction positions 17*a*-17*d*, with an extraction space being arranged in a locally expanded section in the wall of the digester. Open screens are understood as meaning screens which, relative to a chip size having a length of about X mm, a width of about Y mm and a thickness around Z mm, with each respective dimension being normally distributed around each respective mean value X-Y-Z, have a slit width which well exceeds Z mm and can, in accordance with the invention, be on a level with the normally distributed dimension Y or X. When the chips are manufactured normally by means of chipping, the relation between the dimensions X-Y-Z is usually X>Y>Z. The chips are normally packed in the digester in such a way that they lie like playing cards stacked on top of each other, resulting in the chips being orientated such that the dimension Z lies in the longitudinal direction of the digester.

The locally expanded section is formed in a section of the digester where the digester has a first internal diameter above the extraction space and a second internal diameter below the extraction space and where the second internal diameter is greater than the first internal diameter.

The extraction space can preferably be in communication with the pulp column entirely or in part without conventional screens, i.e. without screen members having slits which prevent the extraction of chip pieces from the pulp column, i.e. having a slit dimension which well exceeds the dimension Y and preferably exceeds the dimension X in accordance with the above definition.

Where appropriate, only parts of the extraction space, preferably that part which is directed straight downwards towards the expanded section of the digester, can entirely lack screens, and that part of the extraction space which is directed radially inwards towards the pulp column only possesses supporting bars spars or sparsely arranged screen members which are arranged such that they form gaps which exceed the normal size of the chips.

After the last cooking zone, i.e. the 5th, the cooking liquid is extracted via the screen 17*e* for onward transport to recovery, i.e. REC, or, alternatively, to pre-impregnation.

In the embodiment shown in FIG. 1, a cocurrent flow of cooking liquid is established, i.e. the cooking liquid moves downwards in the same direction as the chips, a feature which is favourable for disturbance-free chip/pulp flow down through the digester and high production capacity, i.e. high flow capacity through the digester. This circumstance is used for being able to add a large amount of alkali initially (calculated in kg per quantity of chips), where there is a high initial consumption. However, due to the high liquid-to-wood ratio, a relatively low concentration of alkali can be established, something which is favourable for the cooking process.

Another advantage is that, despite the consumption of alkali being high initially, the alkali concentration does not fall as much in relative terms due to the high liquid-to-wood ratio. If the liquid-to-wood ratio were lower, the concentration would decrease proportionately to a greater degree during the initial phase of the cooking.

Alternative 1: Typical Conditions when Applying the Invention in FIG. 1.

Figure 3:
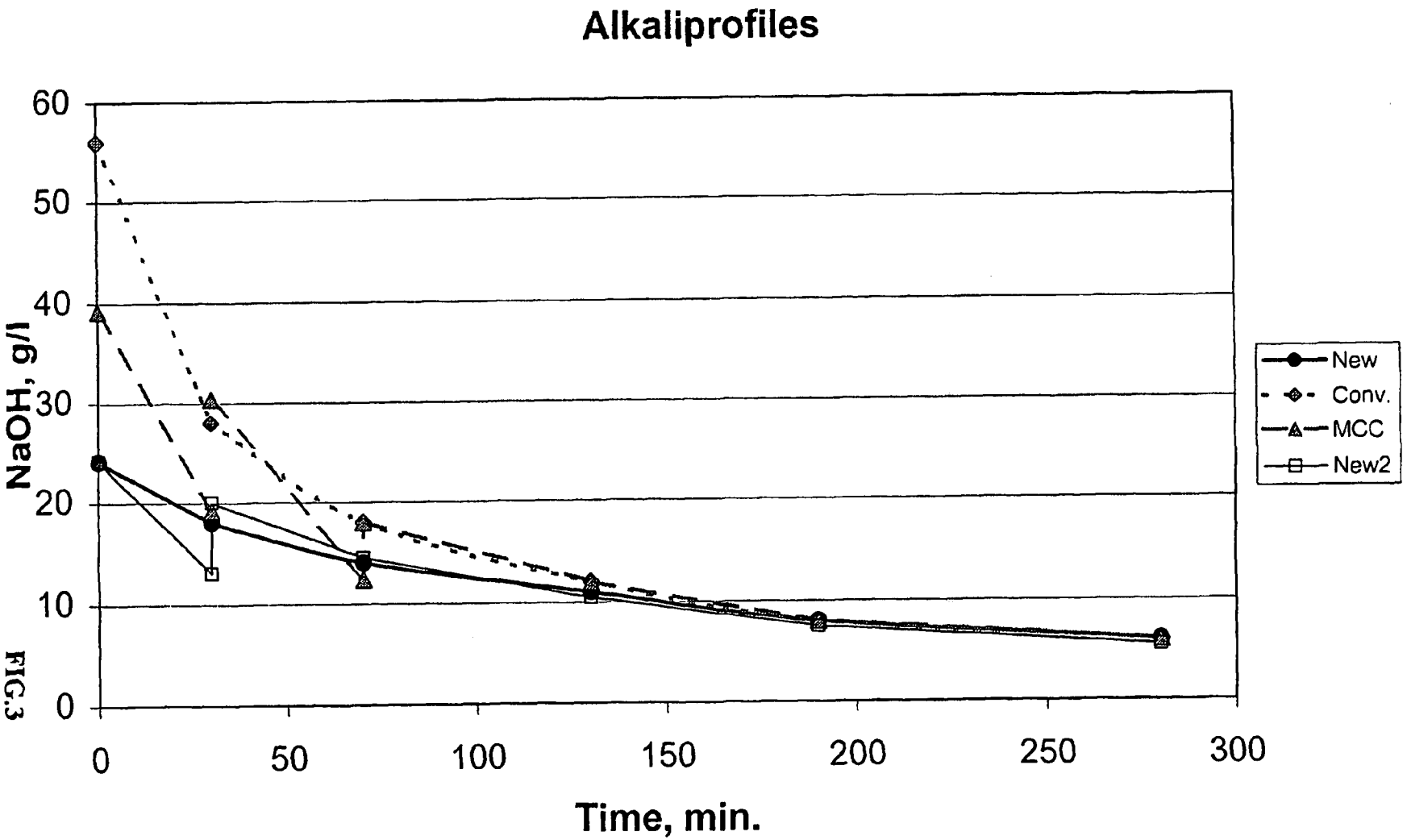
FIG. 3 shows typical alkali profiles through the cooking process when the alkali addition is of the conventional type and of the MCC type, respectively.

In a typical cooking process in which the consumption of alkali is very high initially (see typical consumption rates in FIG. 3 for conventional cooking (all alkali added at the beginning) and MCC cooking (addition of alkali divided up)), the following alkali profile can be established when the invention is applied. The example is based on cooking hardwood (*Eucalyptus globulus*).

In the first zone, i.e. 1st, a liquid-to-wood ratio, L/W, of 11.7:1 is established, i.e., in the zone, there are 11.7 tons of cooking liquid/ton of absolutely dry wood.

According to the invention, a lower alkali concentration is established in the first zone at a level of 24 g/l of cooking liquid. When alkali is consumed normally, the alkali concentration then falls to 18 g/l at the end of the first zone, when the dwell time in the first zone is 30 minutes. The total consumption of alkali is then 70 kg of EA/ton of chips in the first zone (EA=effective alkali).

In the second zone, i.e. 2nd, a liquid-to-wood ratio of 6.25:1 is established by the pump P1 extracting liquid after the first zone. Consequently, 5.45 tons of cooking liquid/ton of absolutely dry wood go to the top. This extraction takes place at an alkali concentration of 18 g/l.

A reduction in the L/W, with the chips being calculated in BDT, by 2 units gives a reduction in the quantity of liquid of 4 $m^3$/BDT for the cooking liquid at a yield of 50%.

When alkali is consumed normally, the alkali concentration then falls from 18 g/l to approximately 14 g/l at the end of the second zone, when the dwell time in the second zone is 40 minutes. The total consumption of alkali is then 25 kg of EA/ton of chips in the second zone. (6.25*(18−14)=25 g/l).

In the third zone, i.e. 3rd, a liquid-to-wood ratio of 5:1 is established by the pump P2 extracting liquid. Consequently, 2.5 tons of cooking liquid per BDT of pulp go to the top. This extraction takes place at an alkali concentration of 14 g/l.

When alkali is consumed normally, the alkali concentration then falls from 14 g/l to approximately 11 g/l at the end of the third zone, when the dwell time in the third zone is 60 minutes. The total consumption of alkali is then 15 kg of EA/ton of chips in the third zone. (5*(14−11)=15).

In the fourth zone, i.e. 4th, a liquid-to-wood ratio of 3.3:1 is established by the pump P3 extracting liquid. Consequently, 3.3 tons of cooking liquid per BDT of pulp go to the top. This extraction takes place at an alkali concentration of 11 g/l.

When alkali is consumed normally, the alkali concentration then falls from 11 g/l to approximately 8 g/l at the end of the fourth zone, when the dwell time in the fourth zone is 60 minutes. The total consumption of alkali is then 10 kg of EA/ton of chips in the fourth zone. (3.3*(11−8)=10).

In the fifth zone, i.e. 5th, a liquid-to-wood ratio of 2.5:1 is established by the pump P4 extracting liquid. Consequently, 1.6 tons of cooking liquid per BDT of pulp go to the top. This extraction takes place at an alkali concentration of 8 g/l.

When alkali is consumed normally, the alkali concentration then falls from 8 g/l to approximately 6 g/l at the end of the fifth zone, when the dwell time in the fifth zone is 90 minutes. The total consumption of alkali is then 5 kg of EA/ton of chips in the fifth zone. (2.5*(8−6)=5).

The total quantity of effective alkali which is consumed during the cooking is then:

$$70+25+15+10+5=125\,kg \text{ of } EA/BDT \text{ of pulp}$$

According to the above example, the quantity of alkali which is consumed in each respective cooking zone, relative to the total consumption in the digester, amounts to:

zone 1: (70/125)≈56%
zone 2: (25/125)≈20%
zone 3: (15/125)≈12%
zone 4: (10/125)≈8%
zone 5: (5/125)≈4%

The total quantity of liquid which is recirculated to the top via the pumps P1-P4 is then 10.9+2.5+3.3+1.6 tons per BDT of pulp, i.e. in all 18.3 tons/BDT of pulp. At the alkali levels which apply at the extractions P1-P4, the aggregate concentration of alkali, Y, in the liquid which is recirculated to the top is obtained as follows:

$$(10.9*18)+(2.5*14)+(3.3*11)+(1.6*8)=18.3*Y \Rightarrow Y=280.3/18.3=15.3(g/l)$$

If all the white liquor were added to the top of the digester, without the above-described recirculation of cooking liquid, the initial concentration of alkali would be 120/2.5+6=56 g/l, that is an alkali content which was more than twice as high as in the proposed system.

In this embodiment, the L/W is reduced between the first and second cooking zones, i.e. the 1st and the 2nd cooking zones, respectively, by 46% (11.7→6.3). This high degree of reduction takes place when cooking raw wood material with a high initial consumption of alkali and can in certain cases reach a reduction of up to 70%. Using other types of raw wood material or a shorter dwell time in the first zone, the reduction in the L/W can amount to just over 20%.

While the reduction in the L/W between the second and third cooking zones is 21% (6.3→5.0), this reduction can be adjusted within the interval 10-60% when using different raw wood materials or dwell times.

While the reduction in the L/W between the third and fourth cooking zones is 34% (5→3.3), this reduction can be adjusted within the interval 10-60% using different raw wood materials or dwell times.

While the reduction in the L/W between the fourth and fifth cooking zones amounts to 24% (3.3→2.5), this reduction can be adjusted within the interval 5-60% using different raw wood materials or dwell times.

The lower degrees of reduction of L/W in the given intervals performed at shorter dwell times in the respective zones and/or when cooking raw wood material having a lower rate of consumption of alkali.

In FIG. 3, the alkali profile is as indicated diagrammatically by the curve labelled NEW, where, for the sake of simplicity, the consumption of alkali is shown to be linear through each respective zone whereas in reality it should fall successively. By comparison, in the case of conventional cooking (conv./dotted curve) of the earlier type, all the alkali was added at the beginning of the cooking, resulting in alkali levels of about 60 grams/litre in order to be able to maintain the alkali level through the cooking.

In the case of MCC cooking (MCC/dashed curve), the addition of alkali was divided up into at least two additions during the cooking. In the case of both conventional cooking and MCC cooking, large variations were obtained in the concentration of alkali during the cooking.

In the case of MCC cooking, a large part of the white liquor charge (30-40%) has to be added down in the digester at a time when the chips are to a large extent dissolved/delignified. Increased packing results in that it possibly will become difficult to obtain a uniform distribution of the added liquor over the whole of the cross section of the pulp column when conventional central pipes are used, for which reason powerful circulations are required in order to guarantee uniform distribution of the white liquor when added at a late stage.

In accordance with the invention, the alkali concentration can instead be maintained with less variation, with the concentration in the typical example varying from 24 g/l down to 6 g/l; however, first and foremost, high alkali concentrations can be dispensed with at the beginning of the cooking. This can be achieved without it being necessary to add large quantities or white liquor/alkali in the intermediate phase of the cooking and, in connection with this, introduce powerful circulations which establish uniform charging with white liquor over the whole of the pulp column.

Figure 2:
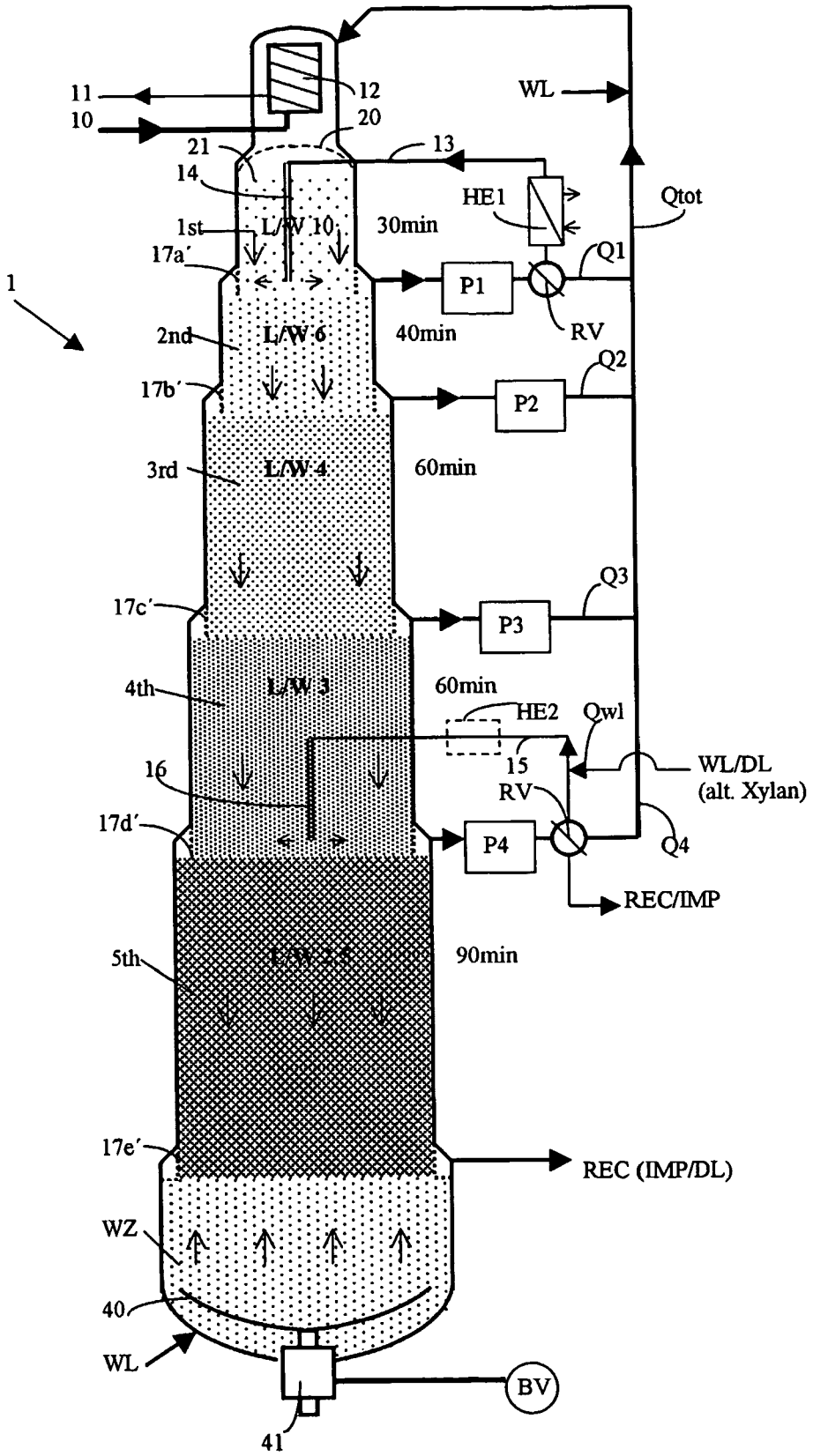
FIG. 2 shows a variant with possibilities for adjusting the temperature and adjusting the cooking liquid in at least two treatment zones.

FIG. 2 shows a second variant of the concept according to the invention. The difference here is that a relatively small quantity of alkali can also be added at the beginning of the fifth cooking zone, i.e 5th, with it being possible to adjust the alkali concentration upwards towards the ideal level by means of a relatively small addition of alkali, WL, to the recirculation 15. As shown in the figure, a relatively small quantity can also be drawn off to recovery (REC) or feedback to pre-impregnation (IMP), which relatively small quantity can correspond to the quantity of white liquor which is supplied.

As an alternative or complement to the alkali, WL, dilution liquid, DL, can be supplied, which dilution liquid is obtained, for example, from a washing stage which follows the digester, with this dilution liquid preferably being in the form of washing filtrate from a diffuser (possibly a pressure diffuser). A heat exchanger, HE2, can also be introduced into the recirculation 15 for the purpose of regulating/adjusting the temperature of the recirculated cooking liquid. The quantity of recirculated cooking liquid can be regulated using a regulating valve RV. In order to establish a uniform distribution of the white liquor, the quantity of liquid which is recirculated in P4-15-16 should be kept relatively high, typically about 7-8 kbm/adt or higher, while the quantity which is recirculated to the top of the digester is on a par with the embodiment in FIG. 1, i.e. around 1 ton per ton of absolutely dry wood.

In yet another embodiment, xylan-rich liquor can also be supplied to the recirculation, as an alternative or complement, which xylan-rich liquor is allowed to reprecipitate xylan onto the fibres, which reprecipitation takes place, in particular, at relatively low alkali concentrations of around 5-7 g/l with the aim of increasing the yield.

FIG. 3 also shows a heating circulation HE1'-13-14, where it is possible to adjust the cooking temperature.

Figure 4:
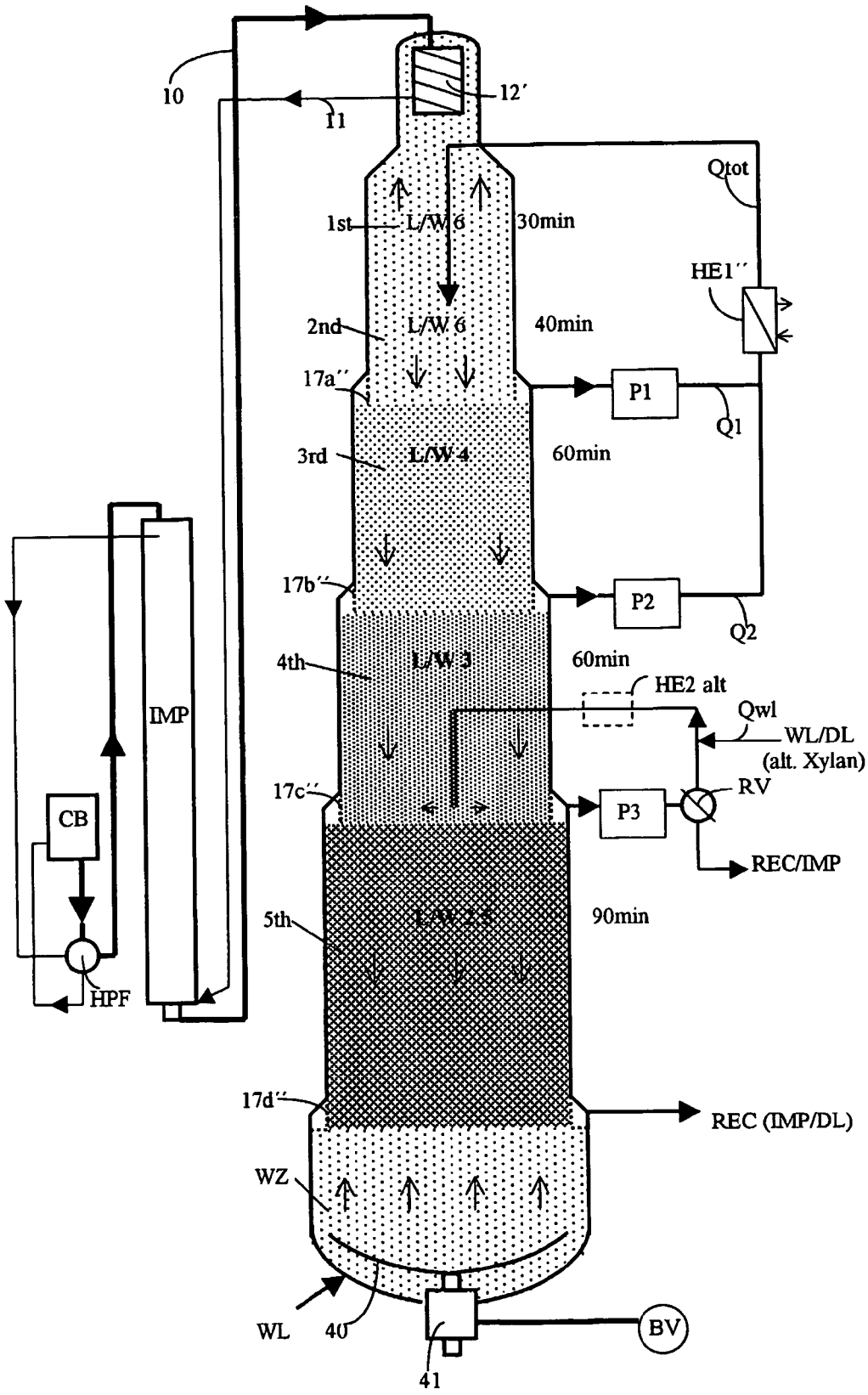
FIG. 4 shows a variant of the invention which is implemented in a hydraulic digester and also in combination with an impregnation vessel.

FIG. 4 shows a third variant which, in this case, is in the form of a hydraulic digester in which the cooking liquid fills the digester completely above the top separator 12'. The top separator in this embodiment is a downwardly feeding separator. In this case, the first cooking zone, i.e. 1st, can be divided into an upper countercurrent zone, i.e. 1st, and a lower cocurrent zone, i.e. 2nd, with both these zones having the same L/W ratio. In this case, three successive cooking zones, in the form of 1st+2nd, 3rd and 4th, having a decreasing liquid-to-wood ratio, are established by means of two pumps, P1 and P2, which recirculate to the top of the digester. A subsequent fourth cooking zone, i.e. 5th, having a decreasing liquid-to-wood ratio, is established by means of the extraction via the pump P3. FIG. 4 shows the digester with a pre-impregnation vessel IMP, in which pre-impregnation takes place, preferably with a high proportion of black liquor, which pre-impregnation vessel is arranged prior to the digester. The high pressure feeder HPF, which feeds in the chip suspension for the transfer to the impregnation from the chip pretreatment CB, is also shown diagrammatically at this point. In the conventional manner, the chip pretreatment can contain a chip conveyor band-chip bin (with or without steaming)-steaming vessel-(with or without) low pressure feeder, in this order.

Figure 5:
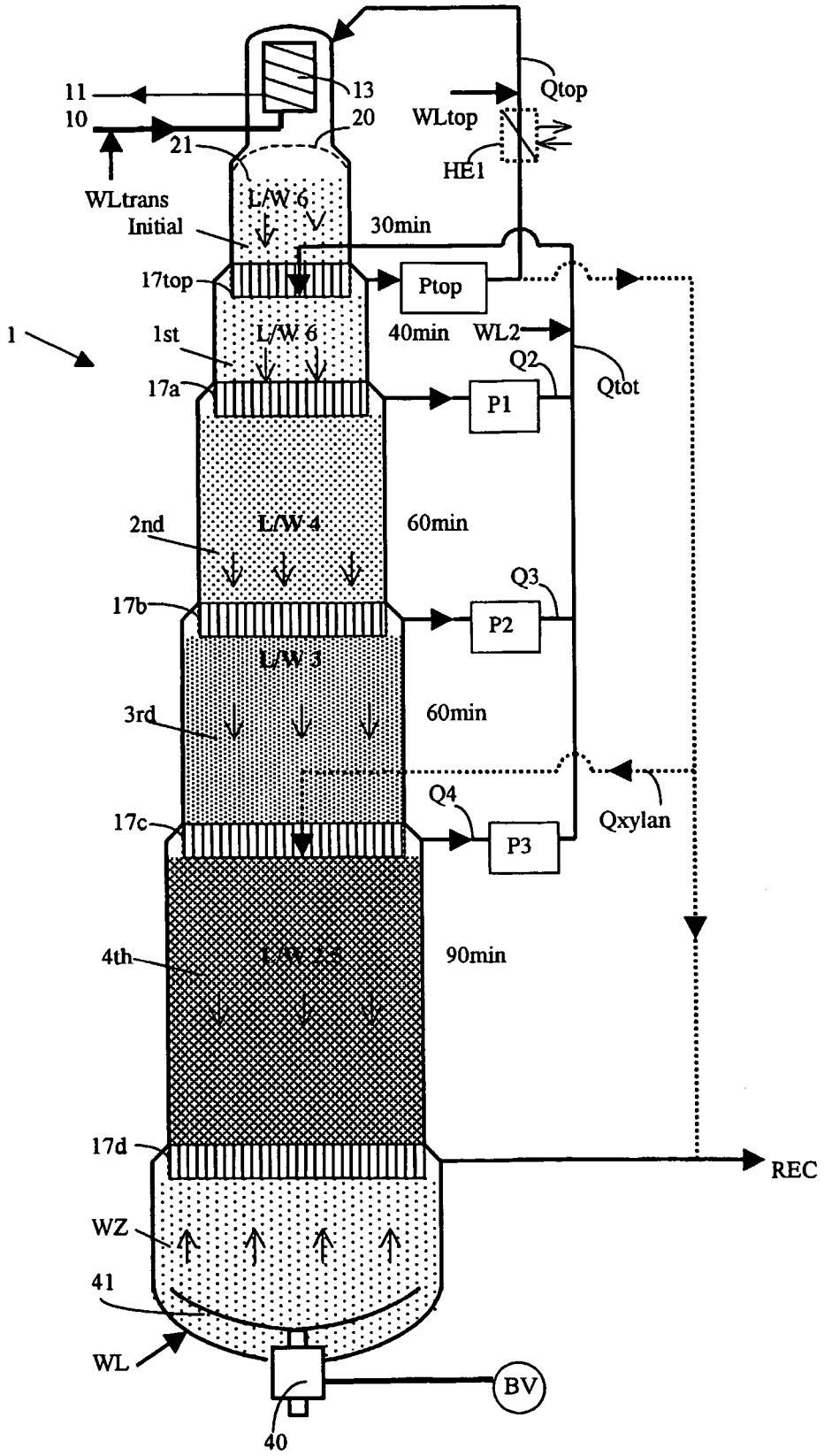
FIG. 5 shows a variant of FIG. 1 in accordance with the invention.

FIG. 5 shows a fourth variant of the invention. While this embodiment is rather like that shown in FIG. 1, it exploits the very rapid reaction process in the uppermost cooking/impregnation zone.

With regard to establishing the cooking liquid, the upper, initial zone is managed separately from subsequent zones, and the 1st-4th zones according to the invention, having a successively decreasing L/W ratio, are established after the upper zone. A typical L/W ratio in the upper, initial zone can be around 5-7, preferably 6 or corresponding to the L/W ratio in the subsequent zone. The alkali concentration is naturally lowered more rapidly if the L/W ratio is lower. If necessary, this can be compensated by a somewhat higher established alkali level at the top of the digester if so desired.

In this variant, the major part of the white liquor required for the cooking, preferably more than 40% and typically nearly 90% of the white liquor required for the cooking, is added to, or before, this first zone. Directly after this first zone, cooking liquid is extracted via the screen 17*a*. In a first alternative, essentially all the cooking liquid which is extracted from the screen 17*a*, i.e. at least 50-90%, is recirculated to the top of the digester. In a second alternative, a certain constituent quantity, typically 10-50%, is drawn off continuously to recovery REC (dotted line).

In certain applications of digesters, in which there is a large proportion of released xylan during the initial phase of the cooking, a certain quantity of the extracted xylan-rich cooking liquid, typically 10-50% of the extracted quantity of cooking liquid, can be recirculated on a level with the screen 17*d* via a central pipe (alternatively, screen 17*c*). In connection with this recirculation, released xylan can be reprecipitated on the fibres, enabling the yield to be increased. In a manner in accordance with the invention, cooking liquid is then extracted via the screens 17*b*, 17*c* and 17*d* and fed back to the digester on a level with the screen 17*a* via a central pipe. As indicated previously, four zones can then be established with successively decreasing L/W ratio. Since the alkali concentration can be low after the first zone, a quantity of alkali is supplied by way of the addition WL2 in the figure. In quantity terms, this addition can amount to 10-25% of the quantity of alkali which is required for the cooking.

The variant shown in FIG. 5 provides an opportunity of obtaining an alkali profile which corresponds to that shown as the curve $NEW_2$ in FIG. 3. While this alkali profile can, of course, be modified in several ways, the adjustment has, in the present case, taken place such that the initial alkali level is minimized and is kept essentially the same as in the embodiment shown in FIG. 1 in the remaining zones. In order to partially compensate for the relatively low alkali level at the end of the first zone, the alkali level can be increased up towards 20 g/l by means of the addition WL2.

The cooking zones according to the invention, having a successively decreasing L/W ratio, are established in the upper part of the digester, either directly from the top of the digester (as in FIGS. 1, 2 & 4) or after a first cooking/impregnation zone of another character (as in FIG. 5).

The invention can be applied to both steam digesters and hydraulic digesters, having an inverted or downwardly feeding top separator (also without top separator), in different combinations.

Similarly, recirculations, of the type 15-16 shown in FIG. 2, can be used at different levels in the digester without it being necessary to depart from the basic concept of the invention. The use of heat exchangers (of the HE1, HE1', HE1" and HE2 type) to heat circulations is introduced to the extent that the cooking process requires the cooking temperature to be regulated or adjusted in the cooking zone in question.

The invention can also be modified in several ways within the context of the enclosed patent claims, such as:

- a lower alkali level in the first phase which is different from the 24 g/l given in the example, in particular when cooking with a higher L/W in zone 1 or when cooking more readily cooked raw wood material, but also in embodiments in accordance with FIG. 5, with alkali being added after a shorter initial zone;
- a higher alkali content than 24 g/l in the first phase, in particular in association with shorter dwell times in this phase or in association with raw wood material which is more difficult to cook;
- at least 3 cooking zones in succession in the digester with successive L/W reduction by at least 15%;
- with cooking zones of another type before and after these three zones, for example with essentially the same L/W ratio in (a) subsequent zone(s) after the last of the three (or in (a) preceding zone(s) (before the first of the three);
- supplemented with a minor alkali adjustment in the last of the three (or more) zone(s) according to the invention, with this alkali adjustment taking place by means of an alkali addition which is less than 20%, preferably less than 10%, of the total alkali consumption in the digester;
- supplemented with different cooking additives such as anthraquinone or polysulphide with a view to increasing the yield of improving the quality of the pulp with regard to strength or other pulp properties;
- in that a minor alkali adjustment can take place before a subsequent cooking zone which follows the last extraction of cooking liquid which is fed back to the top of the digester;
- or in that all the extractions from the whole of the digester are fed back to the top of the digester and in that extractions of used cooking liquor from the cooking process, for onward conveyance to recovery, take place by way of extractions from a subsequent diffuser, preferably a pressure diffuser, or, alternatively, extraction takes place from the impregnation vessel;
- in that the cooking in the digester is concluded with a cooking zone, alternatively in a countercurrent washing zone, where xylan-rich liquor is supplied to the cooking liquid or washing liquid and where the L/W is the same as, or less than, that in preceding zones according to the invention or, alternatively, is greater when the supply is to a washing zone.

The invention claimed is:

1. A process for operating a continuous digester for manufacturing chemical pulp, comprising:

providing the digester with a first treatment zone having a first liquid-to-wood ratio, a subsequent second treatment zone having a second liquid-to-wood ratio and a third treatment zone being subsequent to the second treatment zone, the third treatment zone having a third liquid-to-wood ratio, the first liquid-to-wood ratio being greater than the second liquid-to-wood ratio, the second liquid-to-wood ratio being greater than the third liquid-to-wood ratio, the first treatment zone being above the second treatment zone, the second treatment zone being above the third treatment zone in the digester;

providing the digester with a first extraction position between the first and second treatment zone and a second extraction position between the second and third treatment zone, the first extraction position being above the second extraction position;

feeding a mixture of chips and cooking liquid to a top of the digester;

passing the chips through the first treatment zone;

extracting a first portion of the cooking liquid at the first extraction position and re-circulating the first portion to a reintroduction position in the digester above the first treatment zone to maintain the first liquid-to-wood ratio in the first treatment zone;

passing the chips through the second treatment zone;

extracting a second portion of the cooking liquid at the second extraction position and re-circulating the second portion to the reintroduction position to maintain the second liquid-to-wood ratio in the second treatment zone;

passing the chips through the third treatment zone;

mixing the first and second portions of cooking liquid with the chips at the top of the digester before the first treatment zone;

the dwell time for the chips in the treatment zones lies within the interval 10-120 minutes between the extraction positions, and dissolving the chips to pulp in treatment zones of the digester and feeding out pulp from a bottom of the digester.

2. The process according to claim 1 wherein the liquid-to-wood ratio between the treatment zones is reduced at least 20% from the first to the second treatment zone, and at least 15% from the second to the third treatment zone.

3. The process according to claim 1 wherein the liquid-to-wood ratio in the first treatment zone lies on a par with (10±1.5):1, and, in the second treatment zone, on a par with (6±1):1, and, in the third treatment zone, on a par with (4±1):1.

4. The process according to claim 1 wherein cooking liquid is extracted from at least three extraction positions at different heights in the digester and re-circulated to the top of the digester.

5. The process according to claim 4 wherein the liquid-to-wood ratio is reduced at least 10% from the third to a fourth treatment zone.

6. The process according to claim 5 wherein the liquid-to-wood ratio in the fourth treatment zone lies on a par with (3-4):1.

7. The process according to claim 5 wherein cooking liquid is added at a beginning of a fifth treatment zone.

8. The process according to claim 7 wherein the liquid-to-wood ratio between the treatment zones is reduced at least 5% from the fourth to the fifth treatment zone.

9. The process according to claim 7 wherein the liquid-to-wood ratio in the fourth treatment zone lies on a par with (2-3):1.

10. The process according to claim 1 wherein a largest quantity of cooking liquid is extracted from the first extraction position and in that successively smaller quantities of cooking liquid are extracted from each subsequent extraction position.

11. The process according to claim 10 wherein the quantities extracted between the first and subsequent extraction positions are related to each other as 8 (first extraction):4 (second extraction):2 (third extraction):1 (fourth extraction), with the indicated numbers corresponding to a quantity of extracted cooking liquid calculated in $m^3$/ADT for a digester having a daily production of 2 000 tons.

12. The process according to claim 1 wherein the cooking temperature in the digester is raised in a heating circulation, which heating circulation extracts cooking liquid from outside of a pulp column at a first predetermined level in the digester, which cooking liquid is heated in a heat exchanger before the cooking liquid is conducted back to a middle of the pulp column in connection with the first predetermined level in the digester.

13. The process according to claim 12 wherein the heating circulation is integrated with a system for re-circulating cooking liquid to an upper part of the digester, with one portion of the cooking liquid extracted from an extraction position being forwarded through the heat exchanger and a central pipe to the middle of the pulp column and a second portion being forwarded to the upper part of the digester.

14. The process according to claim 1 wherein at least one adjusting circulation is also installed in the digester, which adjusting circulation extracts cooking liquid from outside of the pulp column at a second predetermined level in the digester, after which the extracted liquid is divided up into two flows, with a first of the flows being withdrawn from the digester and a second flow being fed back to the top of the digester, with a replacement flow containing another liquid being mixed with cooking liquid which is fed back to the top of the digester.

15. The process according to claim 14 wherein the replacement flow containing another liquid consists of dilution liquid which is obtained from a subsequent pulp treatment stage.

16. The process according no claim 14 wherein the replacement flow containing another liquid consists partially of alkali.

17. The process according to claim 14 wherein the replacement flow containing another liquid consists partially of xylan-rich liquor which is obtained in a preceding cooking or impregnation stage in which a high proportion of xylan was released in the cooking liquid.

18. The process according to claim 1 wherein the established cooking zones, having a successively decreasing liquids-to-wood ratio, are preceded in the digester by an initial cooking/impregnation zone, with cooking liquid being extracted after this initial zone and at least 50-90% being fed back to the top of the digester.

19. The process according to claim 18 wherein white liquor is added to the cooking liquid which is recirculated to the top of the digester.

20. The process according to claim 1 wherein the process further comprises the step of adding essentially all cooking liquor to the top of the digester.

21. The process according to claim 1 wherein the process further comprises the steps of providing a third extraction position below the third treatment zone, the second extraction position being above the third extraction position, extracting a third portion of the cooking liquid at the third extraction position and re-circulating the third portion to the reintroduction position to maintain the third liquid-to-wood ratio in the third treatment zone.

* * * * *